United States Patent [19]

Weinhold et al.

[11] 4,370,244

[45] Jan. 25, 1983

[54] PROCESS FOR COLD MECHANICAL WORKING OF METALLIC MATERIALS

[75] Inventors: Harri Weinhold, Kreischa; Heinz-Rüdiger Vogel, Dresden; Bernhard Kurze, Dresden; Gerhard Koch, Dresden, all of German Democratic Rep.

[73] Assignee: Akademie der Wissenschaften der DDR, Berlin, German Democratic Rep.

[21] Appl. No.: 104,160

[22] Filed: Dec. 17, 1979

[30] Foreign Application Priority Data

Dec. 21, 1978 [DD] German Democratic Rep. ... 210023
Dec. 21, 1978 [DD] German Democratic Rep. ... 210025

[51] Int. Cl.[3] ..... C10M 5/16

[52] U.S. Cl. ..... 252/39; 72/42; 252/33.3; 252/40.7; 252/58

[58] Field of Search ..... 252/33.3, 33.2, 39, 252/40.7, 58; 72/42

[56] References Cited

U.S. PATENT DOCUMENTS

| | | | |
|---|---|---|---|
| 2,995,516 | 8/1961 | Stine et al. | 252/40.7 |
| 3,019,190 | 1/1962 | Holzinger | 252/33.3 |
| 3,071,544 | 1/1963 | Rue | 252/33.3 |
| 3,123,561 | 3/1964 | Rue | 252/33.3 |
| 3,287,264 | 11/1966 | Topper | 252/58 X |
| 3,311,555 | 3/1967 | Ehrlenspiel et al. | 252/33.2 |
| 3,367,866 | 2/1968 | Cook et al. | 252/33.3 |
| 3,705,852 | 12/1972 | Fischer | 252/39 |
| 3,723,313 | 3/1973 | Churn | 252/33.3 |
| 3,897,349 | 7/1975 | Marin | 252/33.3 |
| 3,909,431 | 9/1975 | Figiel | 252/58 X |
| 3,928,215 | 12/1975 | Dreher et al. | 252/33.3 |
| 3,953,344 | 4/1976 | Narushima | 252/39 |
| 3,992,303 | 11/1976 | Barker et al. | 252/58 X |
| 4,193,881 | 3/1980 | Baur | 252/39 |
| 4,201,681 | 5/1980 | Lipinski et al. | 252/33.2 |

FOREIGN PATENT DOCUMENTS

| | | | |
|---|---|---|---|
| 47-44136 | 8/1972 | Japan | 252/58 |
| 569520 | 5/1945 | United Kingdom | 72/42 |
| 1177873 | 1/1970 | United Kingdom | 72/42 |
| 1319907 | 6/1973 | United Kingdom | 72/42 |

*Primary Examiner*—Andrew Metz
*Attorney, Agent, or Firm*—Michael J. Striker

[57] ABSTRACT

An improved process for cold mechanical working of metallic materials is disclosed, in which a lubricant containing salts of carboxylic acids with more than ten, and preferably 15 to 20, carbon atoms. The lubricant also contains at least one organic solvent with a boiling point below 200° C., and preferably at least one organic solvent with a boiling point below 30° C. In a preferred embodiment, tensides are added to reduce surface tension. The lubricant combines the advantages of solid and liquid lubricants, and permits the cold mechanical working of materials with high tensile strength.

7 Claims, No Drawings

PROCESS FOR COLD MECHANICAL WORKING OF METALLIC MATERIALS

BACKGROUND OF THE PRIOR ART

The invention concerns processes for the cold mechanical working of metallic materials below their recrystallization temperatures, preferably at room temperature.

The invention more particularly relates to extrusion and drawing of wires, profiles, tubes and sheets, and those systems in which hydrodynamic lubrication prevents direct contact between the material being mechanically worked and the forming apparatus.

For the drawing of metallic materials, solid, partially-solidified or liquid lubricants are used. As liquid lubricants, alkali stearates among others in aqueous solution are known. These lubricants are either lead to the drawing hole as liquids or applied to the material to be worked, dried and then transported with the material to the drawing hole. These lubricants exhibit relatively low dynamic viscosities and are therefore not suitable for the mechanically treating of materials with high tensile strength. Thus, for example, sodium stearate can only be used with materials whose tensile strengths are less than about 1000 N/mm$^2$.

In addition, a continuous process with multistage mechanical working is difficult to achieve, on account of the solvent in the lubricant with a boiling point of 100° C. The drying requires considerable time and much technical outlay, as the dynamic viscosity of the lubricant is reduced when it is insufficiently dry.

Moreover, it is a disadvantage of the prior art processes that the lubricant does not act to dissolve fats, so that under the operating parameters a degreasing pretreatment of the material is necessary.

DESCRIPTION OF THE INVENTION

It is an object of the invention to increase the range of applicability of solid and semi-solid lubricants. It is a further object of the invention to reduce the technical outlay in the cold mechanical treatment of metallic materials.

The inventive process is directed to the goal of achieving the preparation of a homogeneous lubricant with high dynamic viscosity, as is necessary for cold mechanical working of materials with high tensile strength, e.g., greater than 1,000 N/mm$^2$.

This is achieved through the invention by applying on the material to be worked or the surface of the working apparatus a lubricant containing salts of acids with more than ten, and preferably 15 to 20, carbon atoms.

Suitable alkali salts include lithium palmitate, sodium stearate, potassium stearate and lithium stearate. Earth alkali salts, such as the stearates of magnesium, calcium, strontium and barium, may also be used. Ammonium salts, such as ammonium stearate, ethanolammonium and ethyl ammonium stearate, and stearates of iron, cobalt, lead, aluminum, cadmium are also within the scope of the invention.

Palmitic, oleic and stearic acids are examples of carboxylic acids with more than 10 carbons.

Technical benzene may be used as solvent, and the earth alkali salt, calcium stearate with a 29% metal oxide content. To achieve shortened drying times, a solvent with a boiling point below 30° C., or a solvent mixture with at least one component boiling below that temperature, is used. In this case, the lubricant is in dissolved or dispersed form.

Halogenated hydrocarbons are suitable for this purpose. Examples include monofluorotrichloromethane, monofluorodichloromethane, bromofluoromethane, 1-bromo-2-fluorodiethylene, dibromofluoromethane and monobromomonchlorodifluoromethane. Other halogenated organic compounds, such as trifluoroacetone, may also be used.

In a further embodiment of the invention, the lubricants are mixed with a cationic, anionic, amphoteric or non-ionic tenside. The tensides are surface-active compounds, which reduce the surface tension. In this case, the residual films from the lubricant may be easily removed with water, which also may be warmed.

Suitable cationic tensides include fatty acid amides, higher alkylamines and substitution products thereof; anionic tensides include alkyl aryl sulfonates, alkyl sulfates, alkyl sulfonates, alkylarylphosphates, alkyl phosphates and substitution products thereof; betaines can be used as amphoteric tensides, for example, sulfate betaines and sulfobetaines; finally, ethyleneoxy adducts and fatty acid alkylolamides serve as examples of non-ionic tensides.

According to the inventive process, the lubricant is homogeneously applied to the material surface in the liquid state, and remains after evaporation of the solvent as a solid lubricant layer on the material; this can lead to an elimination of the pretreatment of the material with a lubricant carrier, such as a phosphate, oxalate, borate or chalk, which serves to improve the adhesion of the lubricant.

The lubricant combines the advantages of solid lubricant, which on account of high dynamic viscosity can be used for the drawing of materials with high strengths and which can be prepared with minimal technical outlay, with the advantages of liquid or half-solid lubricants, which guarantee a homogeneous lubricant application. The lubricant can be used in multistage processes; the homogeneous lubricant layer on the material guarantees stable treatment conditions and the advantages resulting therefrom.

Through the use according to the invention of solvents with boiling points below 30° C. or solvent mixtures, in which at least one component boils below 30° C., high operational speeds, such as greater than 5 m/sec, can be achieved on account of the low evaporation temperature of the solvent used, even in processes where there are intermediate applications of lubricant.

The inventive use of tensides in the lubricant obviates the customarily necessary aggressive scouring or treatment with organic solvents to remove the residue film from the solvent. There is thereby achieved a considerable saving in organic solvent. With benzene or chlorinated hydrocarbons, the cost is substantially reduced, relative to processes requiring further treatment. Through elimination of other organic solvents, the process is simplified with respect to the protection of workers and of the environment, as well as the associated costs of filtration or purification of exhaust gas.

The invention may be better understood through the following examples.

EXAMPLE 1

An advantageous embodiment of the invention is a process in which the material which is to be cold treated is coated with a lubricant: the organic solvent is benzene. In this solvent, calcium stearate with a metal oxide content of 29% is dissolved. This lubricant is particularly suitable for use in hydrodynamic treatments, such as for forming spring wire. So, for example, a spring wire with an output diameter of 10 mm and an output tensile strength of 1600 $N/mm^2$ with $\epsilon=15\%$ can be mechanically worked up to 80%.

After leaving the drawing nozzle, an exceptional surface quality is exhibited by the material; the material has a homogeneous layer of residual solid lubricant on its surface.

EXAMPLE 2

150 g calcium stearate is dissolved in 0.8 liters benzene. A liter of trichlorofluoromethane is added to the solution. This lubricant leaves a solid and well-adhering layer in half the time previously required. On account of the good dynamic viscosity properties of the lubricant, high process speeds and degrees of treatment may be achieved.

EXAMPLE 3

A lubricant containing in one liter trichloroethylene 90 g calcium stearate with addition of 18 g natrium octadecylbenzene sulfonate in dissolved and/or suspended form is applied to the surface of the material. The resulting solution and/or suspension leads after evaporation of the solvent to lubricants with high dynamic viscosity, which are nonetheless easily dissolved by water, both after working, for example, drawing of wires, tubes or profiles, and after extrusion.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a process for cold mechanical treatment of metallic materials of the type in which a lubricant is used on the surface of the material to be treated or of apparatus for treating, the improvement comprising using as lubricant a liquid composition comprising an organic solvent with a boiling point below 200° C. and selected from the group consisting of benzene, monofluorotrichloromethane, monofluorodichloromethane, bromofluormethane, 1-bromo-2-fluoro-diethylene, dibromofluoromethane, monobromomonochlorodifluoromethane and trifluoroacetone, and a calcium salt of a carboxylic acid with more than 10 carbon atoms, which remains after evaporation of the solvent as a solid lubricant layer on the material.

2. The process as defined in claim 1 wherein the carboxylic acid has from 15 to 20 carbon atoms.

3. The process as defined in claim 1 wherein the calcium salt of a carboxylic acid is calcium stearate.

4. The process as defined in claim 3 wherein the calcium stearate has a content of 29 percent calcium oxide.

5. A process as defined in claim 1, wherein said composition additionally comprises at least a second organic solvent, and wherein at least one of said solvents has a boiling point below 30° C.

6. A process as defined in claim 1, wherein said organic solvent has a boiling point below 30° C.

7. A process as defined in claim 1, wherein said composition additionally comprises tensides.

* * * * *